US006550215B1

(12) United States Patent
Pulte et al.

(10) Patent No.: US 6,550,215 B1
(45) Date of Patent: Apr. 22, 2003

(54) PRECAST CONCRETE WALL SYSTEM

(75) Inventors: William J. Pulte, Bloomfield Hills, MI (US); Lawrence J. Wrass, Granger, IN (US); Robert P. Broad, Ypsilanti, MI (US)

(73) Assignee: PN II, Inc., Las Vegas, NV (US)

( * ) Notice: Subject to any disclaimer, the term of this patent is extended or adjusted under 35 U.S.C. 154(b) by 56 days.

(21) Appl. No.: 09/605,910

(22) Filed: Jun. 28, 2000

(51) Int. Cl.[7] ..... E04B 2/04

(52) U.S. Cl. ..... 52/781.5; 52/781.5; 249/18; 249/21; 249/29; 249/159; 249/189

(58) Field of Search ..... 52/489.2, 274, 52/483.1, 781.3, 781.5; 249/18, 19, 21, 35.37, 29, 189, 192, 193, 159

(56) References Cited

U.S. PATENT DOCUMENTS 4,037,375 A * 7/1977 Maggos et al. ..... 52/220
4,325,532 A * 4/1982 Blank ..... 249/26
5,137,251 A * 8/1992 Jennings ..... 249/189
5,397,096 A * 3/1995 Nelson ..... 249/31
6,012,699 A * 1/2000 Wu et al. ..... 249/189
6,256,958 B1 * 7/2001 Matthews ..... 52/489.2

* cited by examiner

*Primary Examiner*—Carl D. Friedman
*Assistant Examiner*—Yvonne M. Horton
(74) *Attorney, Agent, or Firm*—Rader, Fishman & Grauer PLLC

(57) ABSTRACT

A casting tool for forming precast concrete wall sections. A base is disposed generally in a horizontal plane and has an upper surface. A pair of opposing sidewalls are disposed proximate the upper surface. Each of the sidewalls has a first position in which the sidewall is located substantially in a vertical plane. First and second opposing bulkheads are disposed proximate the upper surface, each having a respective first position in which the bulkhead is located substantially in a vertical plane. The bulkheads are arranged to abut the pair of opposing sidewalls so that the inner surfaces of the sidewalls, the bulkheads, and the upper surface of the base define a form for receiving concrete to make the precast concrete wall section. The first bulkhead is configured for movement so as to vary a first dimension of the form, and thus the dimension of the concrete wall section.

27 Claims, 8 Drawing Sheets

PRECAST CONCRETE WALL SYSTEM

BACKGROUND OF THE INVENTION

1. Technical Field

This invention relates generally to building construction materials and, more particularly, to an apparatus for fabricating precast concrete wall sections.

2. Discussion of the Related Art

It is known to provide prefabricated concrete wall sections for use in, for example, constructing building basements. In general, prefabricated or precast concrete wall sections are generally manufactured using a fixed dimension form. In one known approach a uniform thickness, fixed length wall is provided. In another known approach, a substantially unitary precast concrete wall section is provided having vertically-extending side-edge flanges and a plurality of spaced rib portions separating intervening cavities. Yet another known approach provides a variable length, but fixed, uniform thickness wall section. There are a wide variety of other variations found in the art.

There are several advantages, in general, to the use of precast concrete sections, most notably the increased dimensional control obtained by the manufacturer of the section by the manufacture thereof in a controlled setting. However, there are several shortcomings associated with the known approaches taken in the art for making such wall sections.

One disadvantage pertains to the fixed dimension type form. Since the form is dimensionally fixed, only one size of concrete wall section may be made therefrom. This results in an increased number of forms required to produce the wide range of sizes needed to accommodate various construction requirements. Moreover, since space limitations dictate that not all of the forms can be setup and available for use at all times, only the most frequently used forms are setup. This results in an increased inventory, since the operator generally makes a number of the seldom-needed precast concrete sections, some for later use. Maintaining large inventories of concrete wall sections is undesirable.

While the variable length, uniform thickness type wall section referred to above overcomes some of these shortcomings, the uniform thickness of the wall is undesirable because it leads to increased weight due to unnecessary usage of concrete (i.e., compared to the cavity/rib type wall section). There are substantial difficulties in producing a variable length, cavity/rib type wall section, since if the desired length causes a side end of the wall to fall in the middle of a cavity, such side end will have an insufficient wall thickness, making it structurally unusable.

There is therefore a need to provide an improved precast concrete wall section, and a system for making the same, that minimizes or eliminates one or more of the shortcomings as set forth above.

SUMMARY OF THE INVENTION

The present invention reduces or eliminates large inventories of precast concrete wall sections having a wide variety of dimensions and provides a variable length, rib cavity type wall section. In accordance with the present invention, an adjustable casting tool is provided for forming various-sized concrete wall sections. The casting tool includes a base, one or more pan members, a pair of opposing sidewalls, and first and second opposing bulkheads. The base is configured for orientation in a horizontal plane and has an upper surface. The base further includes a plurality of receiving locations spaced apart along a first axis. Pan members are attached at selected receiving locations. The remaining space on the base unoccupied by pan members defines a remainder length, which is taken along the first axis. The pan members are raised relative to the base to form corresponding cavities in the wall section. The sidewalls are disposed proximate the upper surface of the base. Each of the sidewalls has a substantially vertical first position. The opposing bulkheads are also disposed proximate the upper surface. Each of the bulkheads also has a substantially vertical first position. The first and second bulkheads are arranged to abut the pair of opposing sidewalls such that the pair of sidewalls, the first and second bulkheads, and the upper surface (including the raised pan members) define a form for making the precast concrete wall section. In accordance with the present invention, the first bulkhead is configured for movement along the first axis through the remainder length so as to vary a first dimension of the form.

In effect, pan member may be added to obtain a rough adjustment of the desired length, while the first bulkhead is moveable through the remainder length to obtain a fine adjustment of the desired length. Thus, the present invention eliminates the need for a wide variety of forms to accommodate varying dimensions. In addition, the invention eliminates the need to stock a large inventory of concrete wall sections of variable sizes. The adjustable casting tool provides the means to adjust a first dimension, for example, the length of the concrete wall section. Thus, desired lengths may be formed to accommodate building requirements on an "as needed" basis.

In another embodiment, the height of the form is adjustable.

In yet another aspect of the present invention, a precast concrete wall section is provided. The wall section includes a main body formed substantially of concrete having a preselected height and length. The main body includes a header, a footer, a pair of end sections, at least one rib, and a plurality of cavities. The header laterally extends substantially the preselected length of the main body, as does the footer. The end sections are vertically extending between the header and the footer, and are disposed at opposing side ends of the main body. The rib is also vertically extending between the header and the footer and is laterally spaced from both end sections. The cavities are formed between the header, the footer, the end sections and the rib. The rib separates the cavities and may be used as a "stud" during construction. A first thickness of the main body in the cavities is less than a second thickness of the main body associated with any one of the header, the footer, the end sections, and the rib.

According to the invention, one of the end sections is longer than the other one of the end sections. This provides increased strength, for example, when forming corners using two wall sections. In further embodiments, the header includes at least one of a support beam blockout feature, a window blockout feature, and a reveal feature.

Other objects, features and advantages of the present invention will become apparent to one skilled in the art from the following detailed description and accompanying drawings illustrating features of this invention by way of example, but not by way of limitation.

DETAILED DESCRIPTION OF THE PREFERRED EMBODIMENTS

Figure 1:
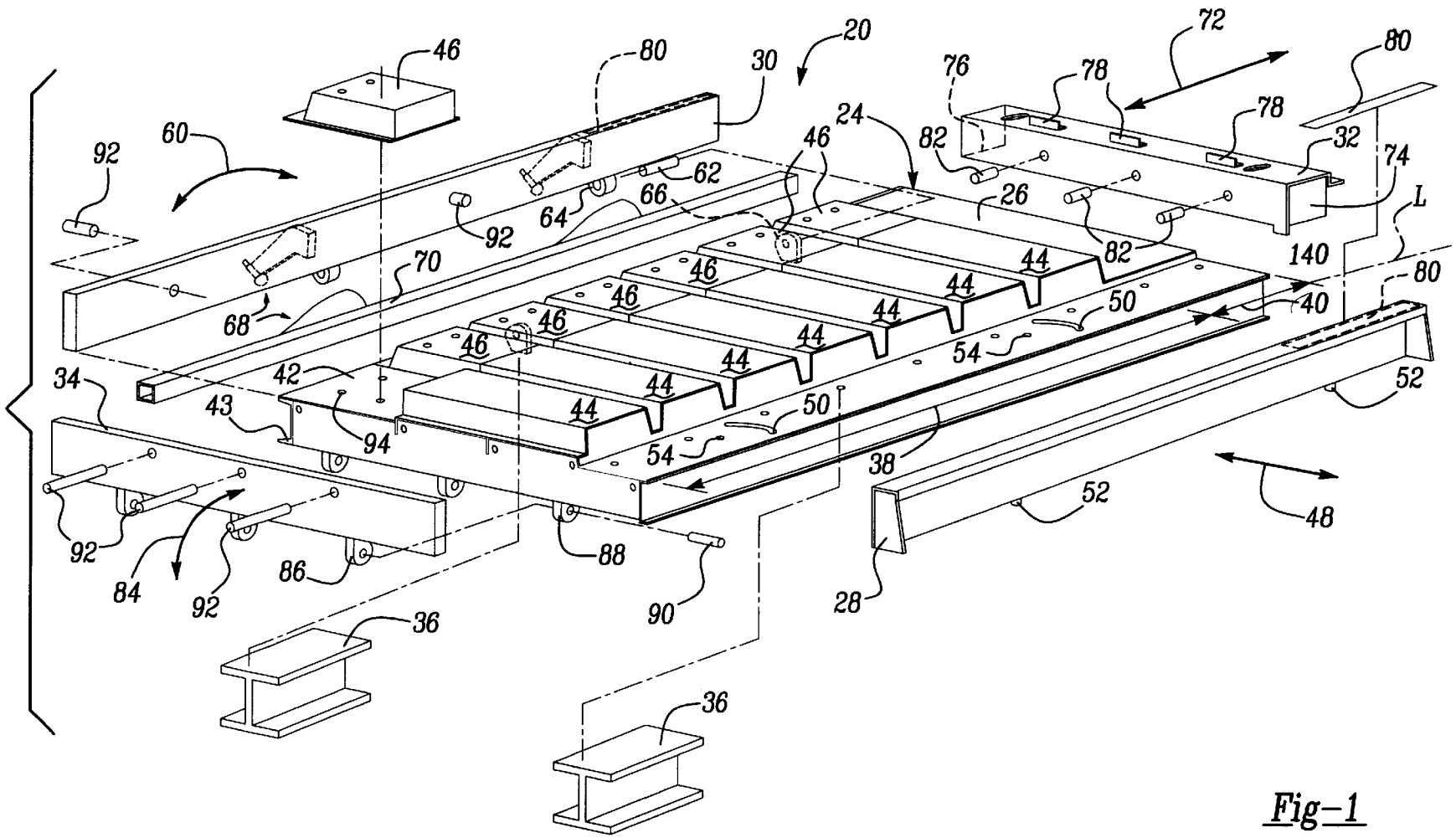
FIG. 1 is a simplified, exploded perspective view of a casting tool for forming precast concrete wall sections according to the invention.

Referring now to the drawings wherein like reference numerals are used to identify identical components in the various views, FIG. 1 is a simplified, exploded, perspective view of a casting tool 20 according to the invention. Casting tool 20 is configured to form a precast concrete wall section 22 (best shown in FIG. 6). Casting tool 20 overcomes a key disadvantage of conventional systems by providing the means to adjust a first dimension (i.e., length) of the "form" defined by the casting tool 20 for wall sections of the type having cavities. This adjustment capability enables manufacture of a wide variety of different-sized precast concrete wall sections 22. The capability provided by casting tool 20 of forming a wide range of wall section sizes means reduced inventory requirements. In the illustrated embodiment, casting tool 20 includes a base 24 having an upper surface 26, a first sidewall 28, a second sidewall 30, a first bulkhead 32, a second, solid corner bulkhead 34, and a plurality of support stools 36. In accordance with the invention, casting tool 20 provides a form that is adjustable along a first axis L associated with the base. The form length comprises a fixed length portion 38, and a variable or remainder length portion 40, as shown in FIG. 1.

Base 24 is configured for orientation, generally, in a horizontal plane, and includes an upper surface 26. Upper surface 26 forms a portion of a complete form into which concrete is poured to make precast concrete wall section 22. Base 24 may include a flat skin portion 42, a generally C-shaped channel 43, and one or more pan members comprising a fixed pan portion 44, and a removable pan portion 46 (shown partially exploded in FIG. 1). Flat skin 42 may comprise metal, such as ¼ inch thick steel. Channel 43 extends generally the length of base 24 and may comprise, in a constructed embodiment, a 12-inch steel channel.

Fixed pan portion 44 is raised relative to flat skin portion 42, and is thus configured to form a corresponding cavity in precast concrete wall section 22. In the illustrated embodiment, base 24 includes a plurality of fixed pan portions 44. Fixed pan portion 44 may comprise ¼ inch thick steel. Fixed pan portion may be a relatively permanent feature of base 24 (e.g., may be welded).

Removable pan portion 46 is configured to be removably mounted to flat skin portion 42. As shown in FIG. 1, removable pan portion 46 is mounted adjacent to a corresponding fixed pan portion 44. Thus, removable pan portion 46 forms an extension of fixed pan portion 44 to thereby extend the corresponding cavity made in precast concrete wall section 22. In the illustrated embodiment, there are a plurality of removable pan portions, corresponding to the number of fixed pan portions 44. However, it should be understood that one or more removable pan portions 46 may be omitted to obtain a desired configuration for concrete wall section 22. Thus, removable pan portion 46 provides a measure of flexibility in the formation of precast concrete wall sections 22. In a constructed embodiment, each removable pan portion 46 is approximately 24 inches wide, as are each fixed pan portion 44. As will be described in greater detail below, the raised portions of the fixed pans 44/removable pans 46 are separated by intervening valleys. The intervening valleys, when filled with concrete (during a concrete pour), form ribs or concrete "studs" integrally formed as a portion of concrete wall section 22. These "studs" are on 24 inch centers, in a constructed embodiment.

Base 24 includes a plurality of substantially evenly spaced receiving locations spaced apart along first axis "L" in FIG. 1. One or more of the pan members (comprising pan portions 44 and 46, as described above), are attached at selected receiving locations on the base 24. In the illustrated embodiment, the receiving locations are 24 inch wide spaces (the pan width referred to above), and may include bolt receiving holes, such as holes 94, or other structural features to assist in locating fixed pan 44 and removable pan 46 in the proper orientation and location on base 24. The spaced occupied by the pan members spans the fixed length 38. The space on the base 24 unoccupied by the pan members defines the remainder length 40. As will be described in greater detail below, for any given, desired length, a certain number of pan members are first selected to obtain a rough approximation of the desired length (e.g., in 24 in increments), then, the first bulkhead 32 is adjusted along axis "L" through the remainder length 40 to obtain the fine approximation of the desired length (e.g., continuously adjustable). The foregoing allows a wall section 22 that includes cavities formed by the pans, but can also be configured for any given length, without an edge falling in the middle of a cavity.

Sidewall 28 opposes sidewall 30, as shown in FIG. 1. Sidewall 28 is disposed proximate upper surface 26 of base 24. Sidewall 28 is moveable between a first position suitable for a concrete pour, designated $\mathbf{28}_{POUR}$ (best shown in FIG. 2), and a second position away from the first position suitable for release of the concrete wall section after the pour, designated $\mathbf{28}_{RELEASE}$ (best shown in FIG. 3). Sidewall 28, in a constructed embodiment, is disposed substantially in a vertical plane in both the first and second positions. To achieve this movement, sidewall 28 includes an assembly to effect a slidable movement in a direction 48 between the first position (pour) and the second position (release). This slidable movement arrangement includes a pair of C-shaped slots 50 formed in flat skin 42, a pair of corresponding rods 52 extending downwardly from sidewall 28, a pair of pivot pins 54 (best shown in FIGS. 2, 3), a corresponding pair of pivot arms 56 (best shown in FIGS. 2, 3), and a pair of actuator assemblies 58 (best shown in FIGS. 2, 3).

Figure 2:
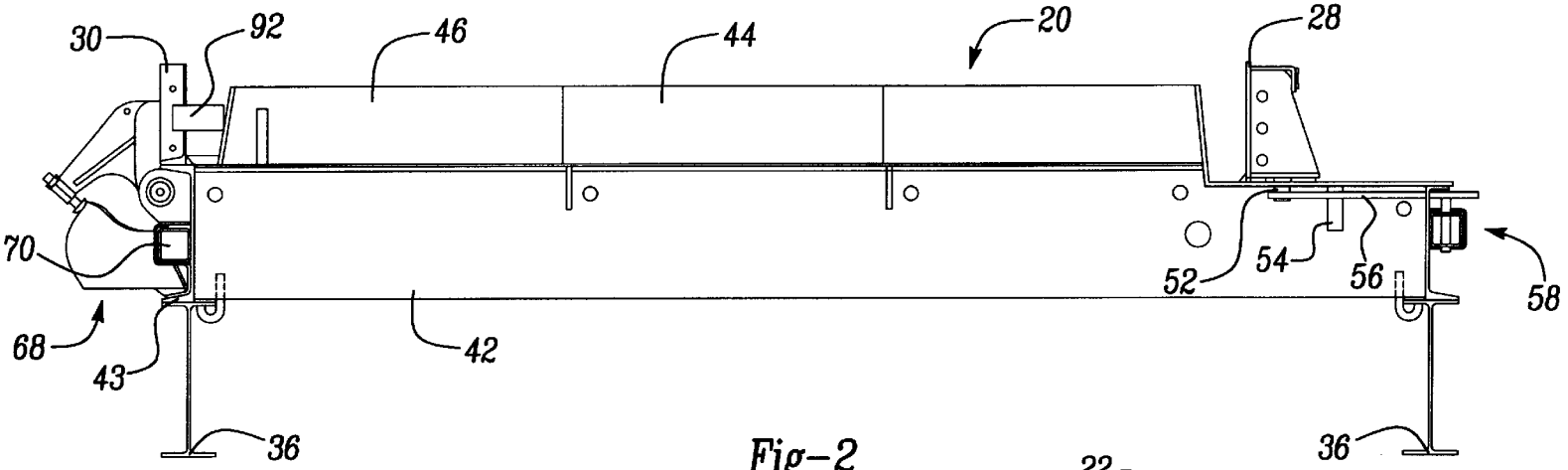
FIGS. 2–3 are simplified side plan views of the casting tool of FIG. 1 showing a pair of sidewalls in a concrete-pour position, and a release position, respectively.
Figure 3:
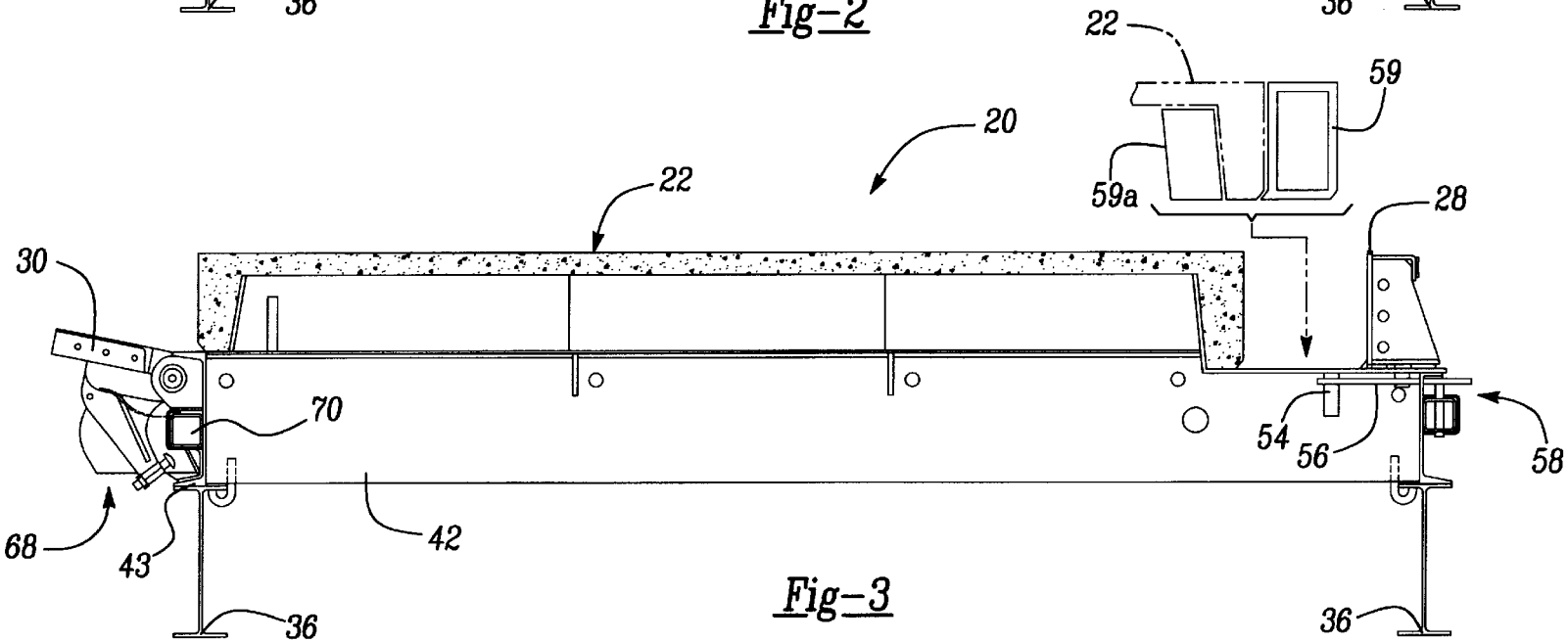

FIG. 2 shows sidewall 28 in the first position suitable for receiving a concrete pour. Actuation of actuator assembly 58 causes pivot arm 56 to pivot about pivot pin 54, which in turn causes rod 52 to travel in the direction 48 through slot 50. FIG. 3 shows sidewall 28 in a release position suitable for removing concrete wall section 22. from casting tool 20. The release position of the sidewall $\mathbf{28}_{RELEASE}$ may be obtained by reversing the actuation of actuator assembly 58. It should be understood that the configuration shown in FIGS. 2 and 3 is exemplary only and not limiting in nature. There are a wide variety of mechanical, and electromechanical arrangements suitable for slidable movement of sidewall 28 in the direction 48, as shown in FIG. 1.

In accordance with another aspect of the present invention, a second dimension of the concrete wall section 22 (e.g., the height) may be adjusted, as well as the length as described above. In a first embodiment, the pour position for the sidewall, $\mathbf{28}_{POUR}$ in FIG. 2, is located so as to establish a maximum height of the wall section (e.g., 11 feet). To obtain varying heights, inserts 59 and 59*a* are provided having a length corresponding to sidewall 28. A height of insert 59 is at least equal to sidewall 28, and a width corresponding to a desired reduction in the height of the wall section 22, relative to the maximum height. Insert 59*a* has a height that is less than insert 59 by an amount equal to thickness "B" (FIG. 4) of wall section 22. Insert 59 is placed adjacent an inner surface of sidewall 28, as shown diagrammatically in FIG. 3. Insert 59*a* is placed against the bottom of the pan members. The bottom of a footer portion of wall section 22 is formed on the opposing side of insert 59. Inserts 59 and 59*a* work together to offset the footer, otherwise, the footer portion would extend upwardly a relatively large distance (e.g., 1–2 feet) when the wall section is installed. For example, insert 59 may be provided in widths of 1 foot (e.g., to provide a 10 foot wall section), and 2 foot (e.g., to provide a 9 foot section). Of course, other widths may be provided. In a second embodiment, the pour position $\mathbf{28}_{POUR}$ is varied via arrangement 58 to obtain the desired height for wall section 22.

Sidewall 30 is disposed proximate upper surface 26 of base 24, and is movable in direction 60 shown in FIG. 1. Sidewall 30 has a first position suitable for receiving a concrete pour, designated $\mathbf{30}_{POUR}$, in FIG. 2. In the first position $\mathbf{30}_{POUR}$, sidewall 30 is disposed generally in a vertical plane. Sidewall 30 further includes a second position suitable for release of the precast concrete wall section 22, designated $\mathbf{30}_{RELEASE}$ in FIG. 3. In the illustrated embodiment, casting tool 20 includes an arrangement for rotatably moving sidewall 30 between the first position (pour) and the second position (release). This arrangement, best shown in FIG. 1, includes a pair of pivots 62 (only one shown in FIG. 1), a pair of first pivot arms 64 extending from sidewall 30, a corresponding pair of second pivot arms 66 extending from base 24 (shown in dashed-line format in FIG. 1), and one or more actuator assemblies 68, coupled to a beam 70.

FIG. 2 shows sidewall 30 in the first (pour) position. Actuation of actuator assembly 68 causes sidewall 30 to rotate to the release position shown in FIG. 3. Reversing the actuation will cause the sidewall 30 to resume the pour position $\mathbf{30}_{POUR}$. It should be understood that there are a plurality of mechanical and electromechanical arrangements for accomplishing the function of rotation between the pour and release positions, as shown in FIGS. 2 and 3.

With continued reference to FIG. 1, first bulkhead 32 opposes second bulkhead 34, each one of bulkheads 32, 34 being disposed proximate surface 26. Casting tool 20 includes a further arrangement for moving first bulkhead 32 in the direction indicated by double arrow-head line 72. Slidable movement in the direction 72 allows adjustment of a first pour position of bulkhead 32 to any one of the plurality of positions through range 40. This adjustability allows varying the length of precast concrete wall section 22. The arrangement for slidable movement in direction 72 includes plates 74, and 76 of bulkhead 32, and angle irons 78. In one embodiment, the "solid" end section achieved by using bulkhead 32 is used to construct foundation wall corners. Casting tool 20 is further provided with a device or apparatus including indicia visible thereon corresponding to a length dimension of precast concrete wall section 22 (i.e., the sum of fixed length portion 38, and remainder length portion 40). As illustrated in FIG. 1, indicia 80 may be disposed on an upper portion of both sidewall 28 and sidewall 30 so that quick and accurate indexing of bulkhead 32 may be made. In a constructed embodiment, the device having indicia 80 may be a ruler. Once the bulkhead 32 has been positioned as desired, using both rulers 80 to achieve a desired parallel orientation, it may be held in place by mechanical clamps, which may comprise conventional hardware.

Bulkhead 32 further includes one or more pegs 82 extending from an inner surface thereof. Pegs 82 are configured to displace concrete from an end section portion of concrete wall section 22 to thereby form through-bores. The resulting through-bores may be used, in a constructed embodiment, for attaching a pair of precast concrete wall sections together, either in an "in-line" arrangement, or, in one of an interior and exterior corner arrangement, as described in greater detail below.

Second bulkhead 34 is also disposed proximate surface 26 and includes a first position suitable for receiving a concrete pour. In a constructed embodiment, casting tool 20 includes an arrangement for allowing rotation of bulkhead 34 in the direction indicated by double arrow-head line 84 (FIG. 1). The arrangement includes a plurality of first and second pivot arms 86, 88, and a corresponding plurality of pivot pins 90. As shown in FIG. 1, plugs 92 are also provided, and may be inserted through corresponding through-holes in bulkhead 34 and inserted so as to extend into the form. As with pegs 82, the purpose of plugs 92 is to create through-holes in an end section of precast concrete wall section 22 for fastening adjacent wall sections 22 via fasteners. It should be understood that while plugs 92 are shown to be removable, and pegs 82 are shown to be fixed, the approaches (removable or fixed) may be mixed and matched, or omitted entirely from casting tool 120, and remain within the spirit and scope of the present invention. In addition, sidewall 30 may also include plugs 92, as shown in perspective in FIG. 1, and in a side view in FIG. 2. Plugs 92 for sidewall 30 provide through-holes in the header of wall section 22 for bolts and the like to allow attachment of, for example, a sill plate or the like.

Support stools 36 are configured to elevate base 24 from ground. Although only two supports stools 36 are shown in FIG. 1, in one constructed embodiment, four such stools are used to support base 24, while in a further embodiment, six such stools 36 are used to support base 24. As shown more particularly in FIG. 3, without support stools 36, there may be insufficient clearance for actuator assembly 68 to fully retract sidewall 30 to the release position. In a constructed embodiment, stools 36 may comprise a section of a steel I-beam. The number of stools 36 may depend on the length of the table supported.

Referring to FIG. 2, casting tool 20 is shown having sidewalls 28, and 30 moved to respective first, pour positions $28_{POUR}$ and $30_{POUR}$. Although not shown in FIG. 2, prior to the pour operation, bulkhead 32 is likewise moved to a first position, and second bulkhead 34 is also moved to its first, pour position. Configured as described, the outer longitudinal end surfaces of first bulkhead 32 abut or engage the inner surfaces of sidewalls 28 and 30. In addition, the inner surface of second bulkhead 34 abuts longitudinal end surfaces of sidewalls 28 and 30.

The inner surfaces of sidewalls 28 and 30, and bulkheads 32, and 34, in combination with surface 26 of base 24 define a casting form for the manufacture of precast concrete wall section 22. In the orientation shown in FIG. 2, a footer portion of precast concrete wall section 22 will be formed near sidewall 28, and a header portion will be formed near sidewall 30. Conventional release agents may be applied to the surfaces described above defining the form before the concrete pour. Casting tool 20 is now ready to receive concrete.

FIG. 3 shows casting tool 20 after the poured concrete has cured, and sidewalls 28 and 30 have been moved to their respective, second, release positions $28_{RELEASE}$ and $30_{RELEASE}$, respectively.

Figure 4:
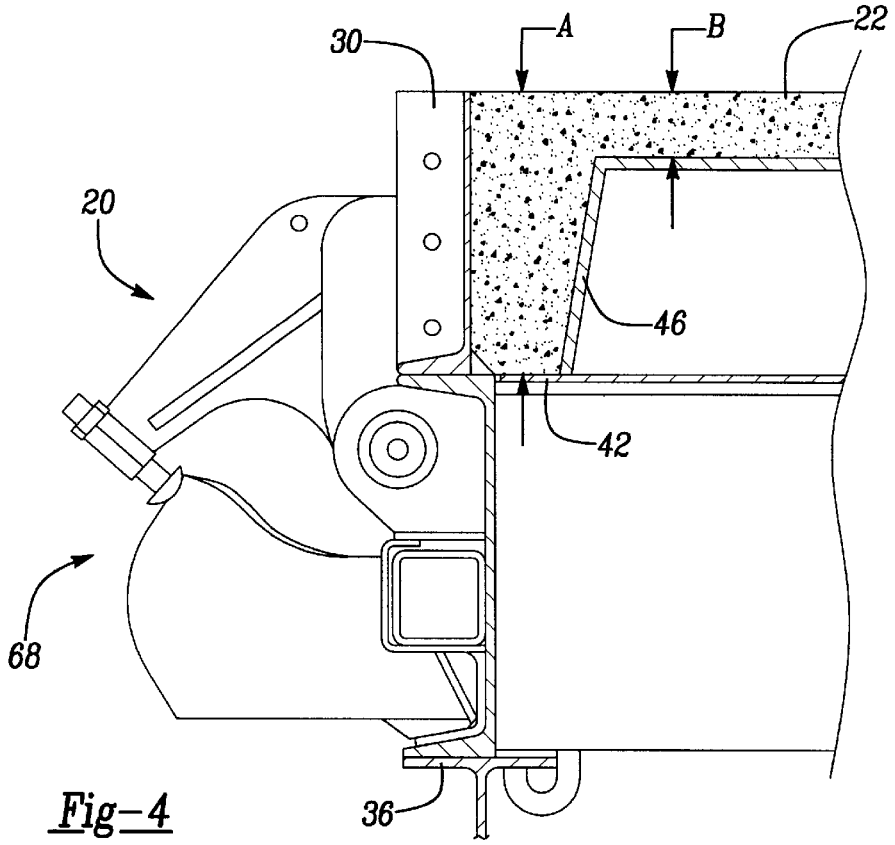
FIG. 4 is a simplified side plan view showing, in greater detail, the casting tool of FIG. 1 after being filled with concrete but before the sidewall has been moved to the release position.

FIG. 4 shows, in greater detail, casting tool 20 after being filled with concrete but prior to movement of sidewall 30 to the release position. As shown in FIG. 4, removable pan 46, being raised from flat skin 42, displaces concrete to thereby form a cavity in wall section 22. A header portion of wall section 22 is shown having a first thickness, designated "A", while the wall section 22 in the area of the cavity has a second thickness, designated "B", that is less than the first thickness "A". Advantageously, the reduced thickness in the pan region substantially reduces the overall weight and use of materials, while maintaining needed structural strength.

Figure 5:
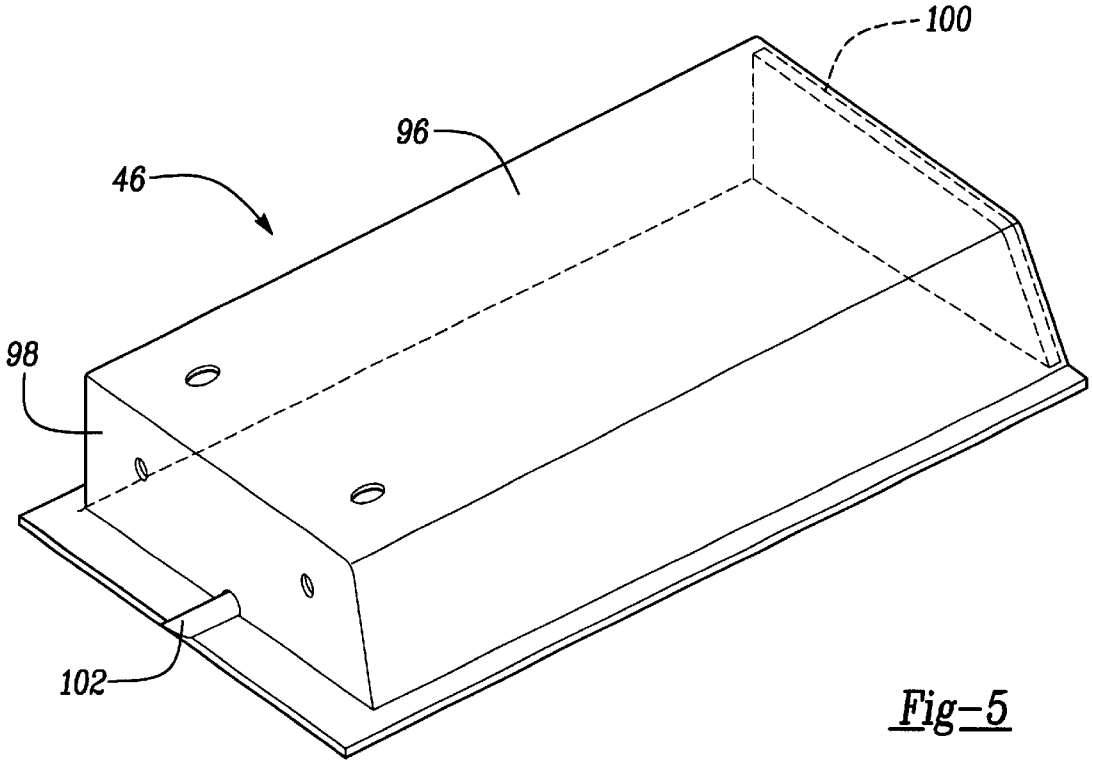
FIG. 5 is a perspective view of a removable pan portion of the casting tool of FIG. 1.

FIG. 5 shows removable pan 46 in greater detail. Removable pan 46 is configured to be removably secured to base 24 through the use of conventional fasteners. Removable pan 46 includes a body portion 96, a cap portion 98, a diaphragm portion 100, and, optionally, a reveal member projecting from cap portion 98. Removable pan 46 may be mounted to base 24 using fasteners disposed through top holes through body portion 96, and corresponding apertures 94 in flat skin 42 (best shown in FIG. 1). Cap 98 and diaphragm 100 may be formed of metal, such as steel, and are disposed at opposing ends of body 96. Other materials, such as rubber or fiberglass may also be used. When mounted to flat skin portion 42, the diaphragm portion 100 is disposed proximate fixed pan 44. Reveal member 102 is disposed in relief relative to flat skin portion 42 and is configured to form a corresponding, incuse reveal feature in precast concrete wall section 22.

Figure 6:
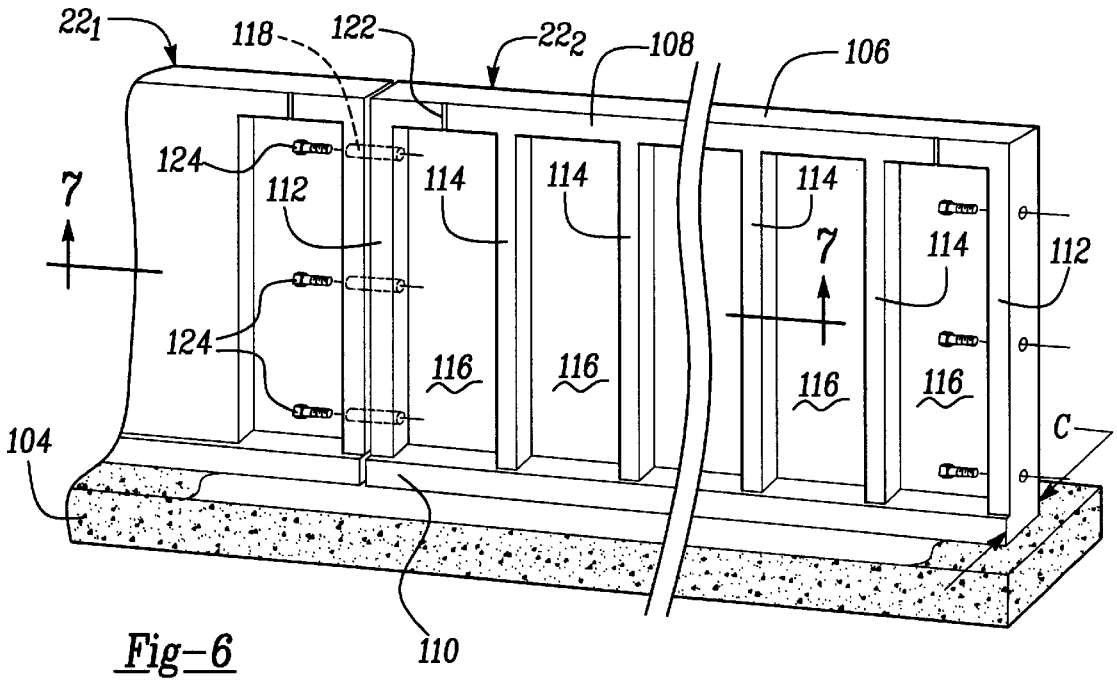
FIG. 6 is a simplified, perspective view of a pair of adjacent precast concrete wall sections in an "in-line" arrangement.

FIG. 6 shows a pair of concrete wall sections designated $22_1$, and $22_2$, disposed "edge-to-edge" for in-line assembly. In a typical configuration, wall sections 22 will be manufactured in a controlled setting (i.e., a shop), and will be deployed in the field for construction of a home or other building project. In a common configuration, wall sections 22 may, as deployed, rest on a bed 104 of compacted stone (e.g., gravel).

Each wall section 22 includes a main body 106, a header 108, a footer 110, a pair of end sections 112, at least one rib 114, and a plurality of cavities 116. Main body 106 is formed substantially of concrete and has a preselected height and length, which may be varied using inventive casting tool 20. Header 108 laterally extends substantially the entire preselected length of main body 106, as does footer 110. End sections 112 are disposed at opposing side ends of main body 106 and each extend vertically between header 108 and footer 110. Ribs 114 also extend vertically between header 108 and footer 110, and are laterally spaced from end sections 112. Cavities 116 are formed between header 108, footer 110, end sections 112, and ribs 114. As best shown in FIG. 4, main body 106 has a first thickness, designated "A" in header 108, and a second thickness, designated "B" less than the first thickness in cavities 116. As shown in FIG. 6, footer 110, in a constructed embodiment, has a third thickness, designated "C", that is greater than either the thickness of main body 106 ("A") and cavities 116 ("B"), or the thickness in any one of header 108, ribs 114, or end sections 112.

With continued reference to FIG. 6, end sections 112 are formed with through-bores 118 through the use of, for example, pegs 82 (best shown in FIG. 1) or plugs 92 (best shown in FIG. 1).

Concrete wall section 22 may further include an incuse reveal feature 122 in header 108, corresponding to reveal member 102 of removable pan 46 (best shown in FIG. 5). Feature 122 may be used for routing electrical wiring, plumbing pipes, or other mechanical services.

Conventional fasteners 124 may be used, in combination with preexisting through-bores 118, to secure adjacent wall sections 22 together. For example, wall section $22_1$, and $22_2$, when deployed in the field, may be attached together.

Figure 7:
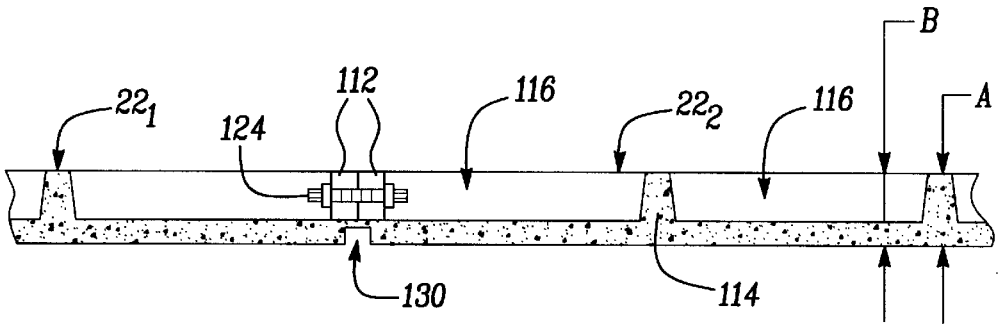
FIG. 7 is a simplified, cross-section view taken substantially along lines 7—7 of FIG. 6.

FIG. 7 is a cross-section view taken substantially along lines 7—7 in FIG. 6. As shown in FIG. 7, fastener 124 may be employed to secure adjacent wall sections $22_1$, and $22_2$ in an in-line arrangement. In a constructed embodiment, fasteners 124 comprise ½ inch (diameter)×5½ M inch (length) steel bolts, including suitable washers and nuts.

Figure 8:
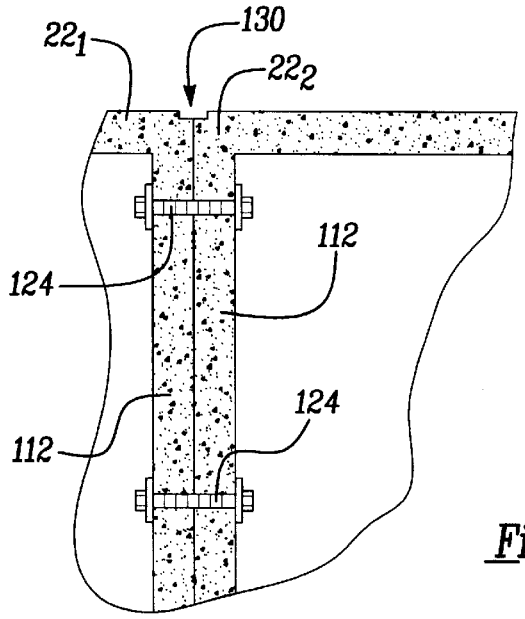
FIG. 8 is a partial cross-section view, with portions broken away, taken vertically through the attachment of the concrete wall sections shown in FIG. 6.

FIG. 8 shows a partial cross-section view of the attachment arrangement illustrated in FIG. 6. In FIG. 8, multiple fasteners 124 are illustrated.

Figure 9:
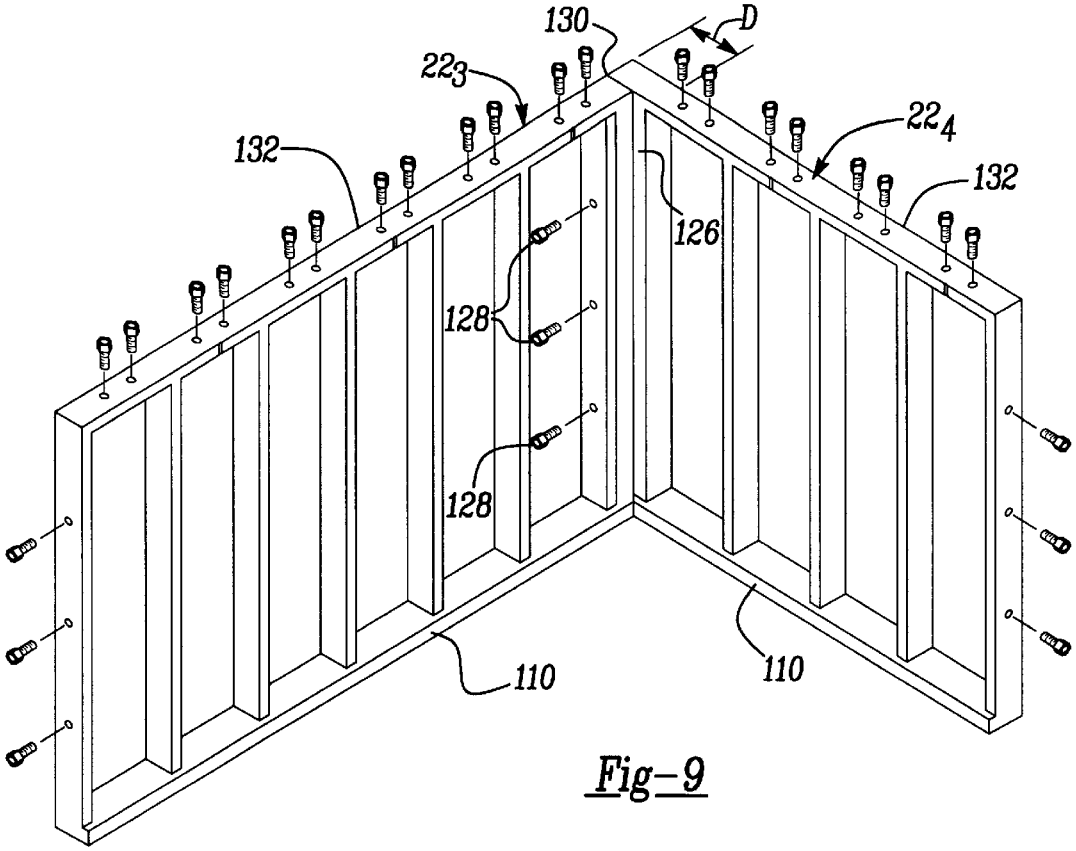
FIG. 9 is a simplified, perspective view of an exterior corner arrangement formed using a pair of wall sections.

FIG. 9 shows an arrangement used to form a substantially 90° exterior corner (i.e., outside portion of corner faces outwardly with respect to the basement, and therefore abuts the earth). As shown, section $22_3$ is attached to section $22_4$. In accordance with the present invention, in a corner configuration, one of the precast concrete wall sections, such as section 224, is integrally formed with a solid cast corner end section 126 having a variable length "D". In a constructed embodiment, for corner arrangements, a plurality (e.g., three) of fasteners 128 are used to secure the wall sections. Fasteners 128 may comprise ½ inch (Length) steel anchors. Another feature of the present invention involves the provision of an outside notch 130, which is provided on a side 132 of section 22. Side 132 is configured to contact earth. Notch 130 is configured to receive a sealant or the like, to effectively seal out water. The notch provides a mechanism to obtain a more repeatable sealant application than if no notch were present and the seam between the two wall sections were simply caulked. The notch guides the installer to apply an adequate amount of sealant.

Figure 10:
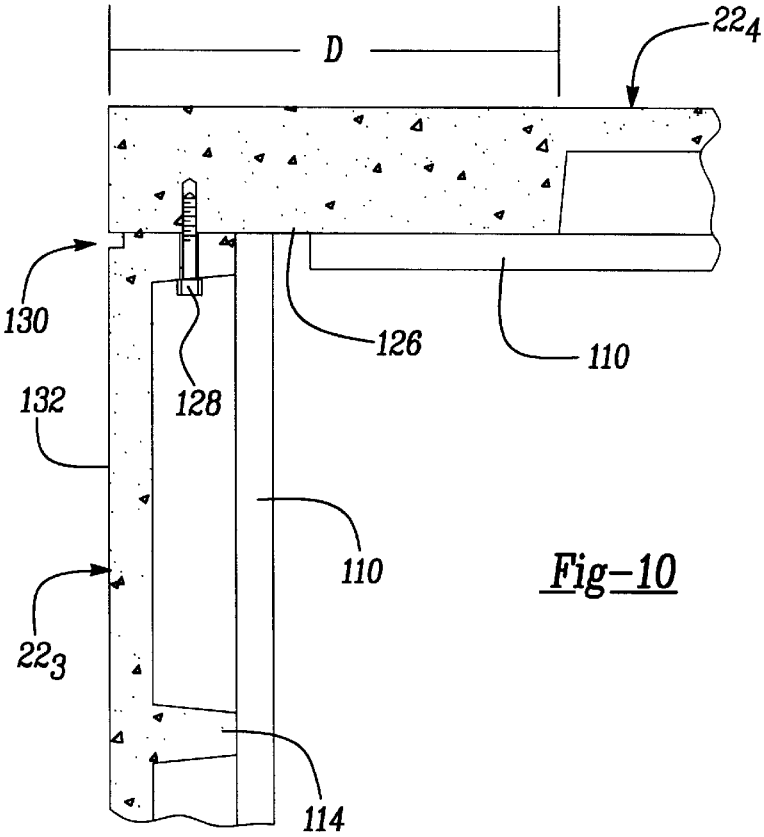
FIG. 10 is a simplified, cross-section view of the exterior corner arrangement of FIG. 9.

FIG. 10 shows the attachment between wall section 223, and $22_4$, in greater detail. In particular, notch 130 is more clearly shown. In addition, the section shown in FIG. 10 is taken from a "top-down" orientation. Accordingly, footer 110, which is thicker than main body 106, is shown extending inwardly towards an interior volume of a basement. In contrast, footer 110 is not shown in FIG. 7, inasmuch as FIG. 7 shows a "looking up" view.

Figure 11:
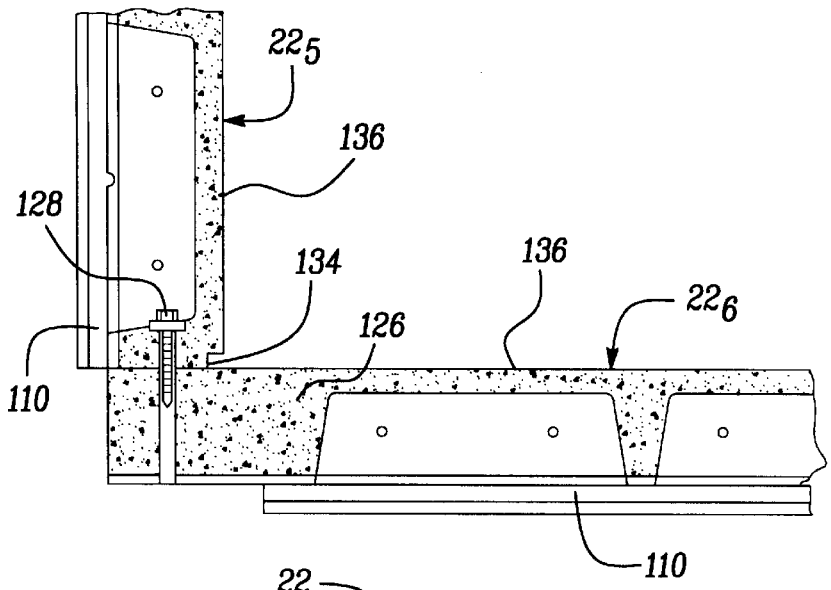
FIG. 11 is a simplified cross-section view of an interior corner formed using a pair of wall sections.

FIG. 11 shows a partial cross-section view of an arrangement for forming an interior corner using precast concrete wall sections $22_5$, and $22_6$. In particular, FIG. 11 shows notch 134, configured to receive sealant or the like to prevent the ingress of undesirable elements, such as water. For reference, outside surfaces 136 contact earth when sections $22_5$ and $22_6$ are deployed in the field.

Figure 12:
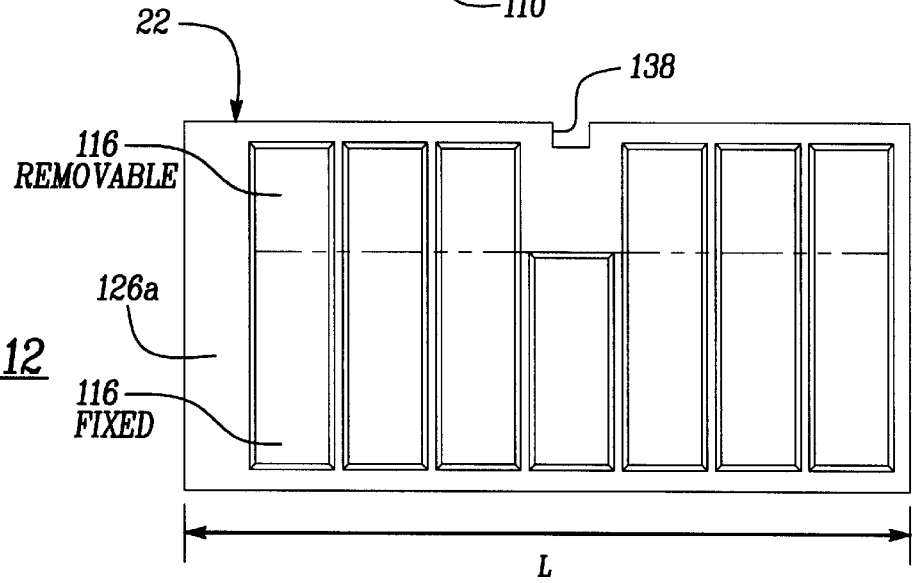
FIGS. 12–13 are simplified, side plan views showing concrete wall sections having a support beam blockout, and a basement window blockout, respectively.
Figure 13:
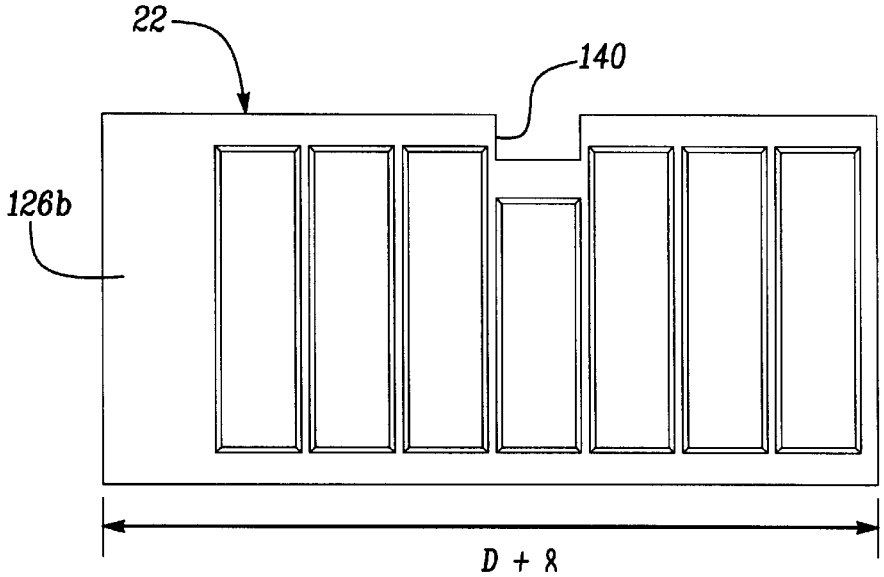

FIG. 12, and FIG. 13 show concrete wall sections 22 that include a support beam cutout feature 138, and a basement window cutout feature 140, respectively. Features 138, and 140 may be formed by employing corresponding support beam blockout and basement window blockout members, similar to removable pan 46, to prevent concrete from occupying the cutout space. As shown in FIG. 12, cavity 116 may be viewed as having a portion $116_{FIXED}$ attributed to the use of fixed pan 44, extending into a portion of cavity designated $116_{REMOVABLE}$, attributed to the use of removable pan 46. Note that to obtain beam cutout feature 138, removable pan 46 for that region is not used, thereby resulting in a thicker, solid main body portion in the area of feature 138. Further note that with respect to FIG. 13, removable pan 46 is also omitted in the area of casting tool 20 where basement window feature 140 is formed. It should be understood that the removable pan portion 46 may be omitted from more than one receiving location, to obtain multiple, foreshortened cavities in the resulting wall section. In addition, end section 126*a* (FIG. 12) is of such length that a total length of precast concrete wall section 22 is D. In FIG. 13, end section 126*b* has been elongated, resulting in an overall increase in length, designated D+1.

Figure 14:
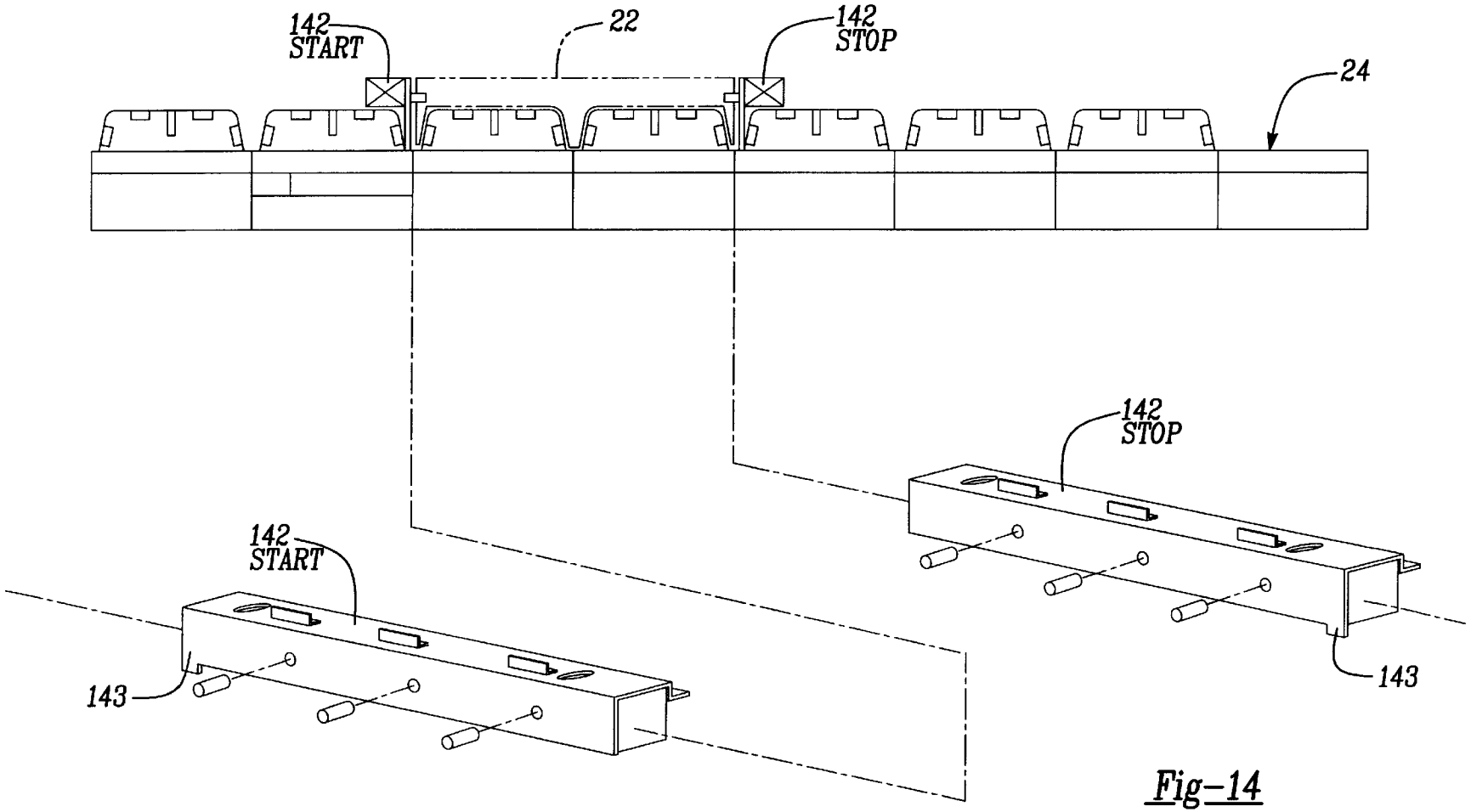
FIG. 14 is a combined section and perspective view showing deployment of start and stop bulkheads.

FIG. 14 shows use of a start bulkhead $142_{START}$ and a stop bulkhead $142_{STOP}$. While base 24 provides the capability of forming relatively long wall sections 22 (e.g., 16 feet), there is a commercial need for wall sections having a reduced length (e.g., approximately 6 feet). Start and stop bulkheads $142_{START}$, $142_{STOP}$, as shown in FIG. 14, may be disposed between pan members to define a reduced length "form". Each bulkhead includes a respective leg portion 143 which corresponds to the step in the upper surface of base 24, best shwon in FIG. 1.

Figure 15:
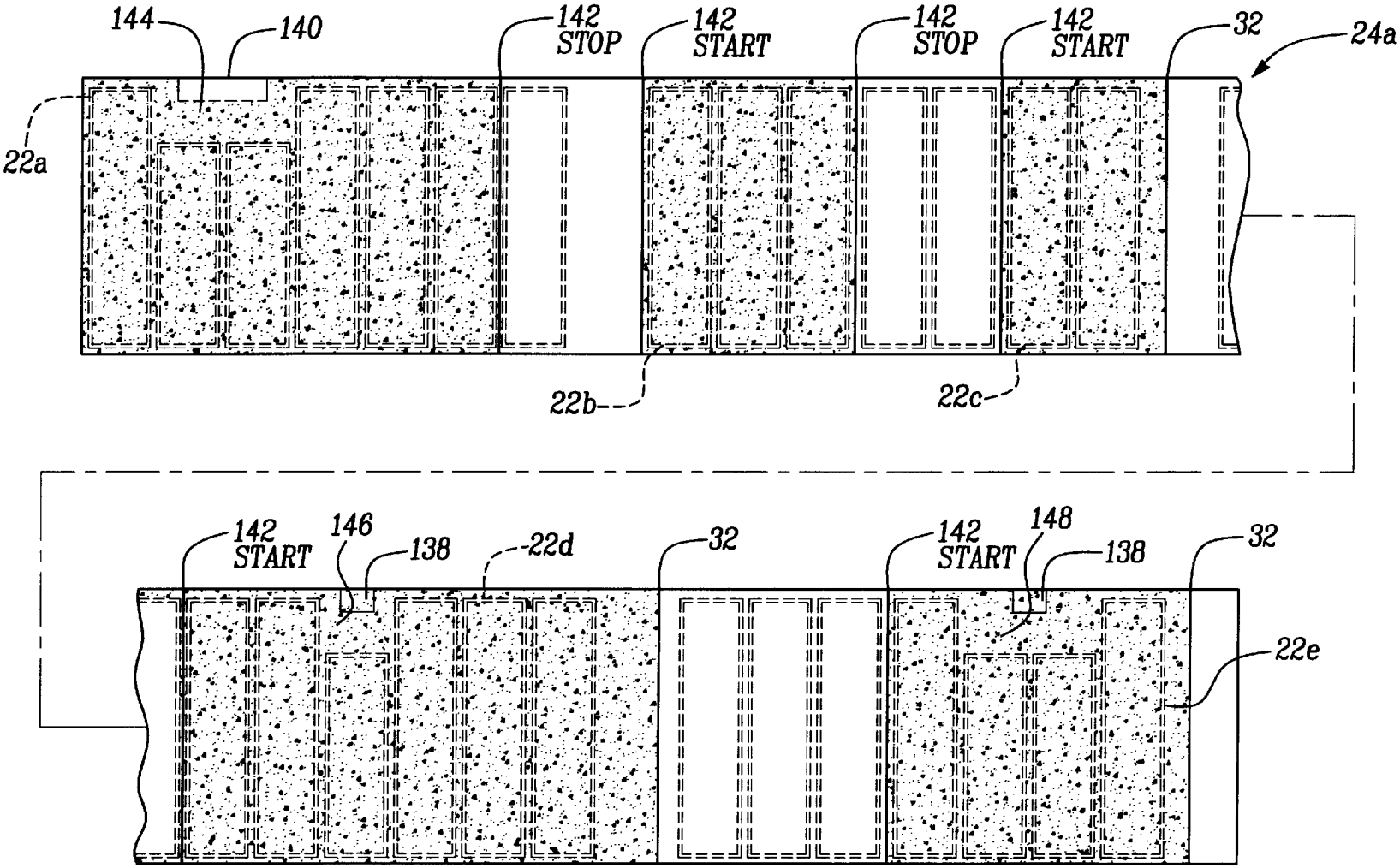
FIG. 15 is a top plan view showing an extended length base used as an assembly line for making wall sections.

FIG. 15 shows an assembly line for producing a plurality of wall sections having varying lengths. FIG. 15 shows an extended length base 24*a*. A first wall section 22*a* is shown having an exemplary length of 12 feet, 2 inches. The wall section 22*a* includes a basement window blockout 140 in a relatively thickened area 144 achieved by removing two adjacent removable pan sections 46. The form for making wall section 22*a* is bounded on the right side by a stop bulkhead $142_{Stop}$. A second wall section 22*b* is constructed from a form that is bounded by a start bulkhead $142_{START}$ and a stop bulkhead $142_{Stop}$. Wall section 22*b* has a shorter length than wall section 22*a* and, as illustrated, is approximately 6 feet, 2 inches long.

Wall section 22*c* has a length that is reduced relative to wall section 22*b*. The form for constructing wall section 22*e* is bounded by start bulkhead $144_{START}$, and solid corner bulkhead 32. Note that with wall sections 22*a,* and 22*b,* the total lengths are approximately whole integer multiples of a single pan member width. However, wall section 22*c,* has a total length comprising a rough approximation of two pan members wide plus a fine approximation provided by the adjustment of solid corner bulkhead 32. Through the foregoing, a variable length, cavity-type concrete wall section can be formed.

Wall section 22*d* includes a beam pocket blockout 138 surrounded by a thickened solid portion 146 formed by removing one removable pan. The form for constructing wall section 22*d,* is bounded on the left by a start bulkhead $142_{START}$, and bounded on the right by solid corner bulkhead 32. As illustrated, wall section 22*d* is approximately 13 feet 10¾ inches long.

Finally, wall section 22*e* includes a beam pocket blockout 138 surrounded by a thickened solid area 148 formed by the removal of two removable pans. Comparing wall sections 22*d,* 22*e,* illustrates that either one, or two removable pans may be removed to accommodate beam pocket blockout 138, depending on the actual desired position of the beam pocket blockout. The form for constructing wall section 22*e* is formed on the left by start bulkhead $142_{START}$ and bounded on the right by solid corner bulkhead 32. In the illustrated embodiment, wall section 22*e* is approximately 8 feet, 6¼ inches long.

A casting tool 20 in accordance with the present invention overcomes shortcomings of known systems by providing an adjustable bulkhead, which allows producing a plurality of differing length concrete wall sections 22. As a result, large inventories of wall sections 22 need not be kept, as required by prior systems.

While the invention has been particularly shown and described with reference to the preferred embodiments thereof, it is well understood by those skilled in the art that various changes and modifications can be made in the invention without departing from the spirit and scope thereof.

We claim:

1. A casting tool for forming a pre-cast concrete wall section comprising:

a base having an upper surface and configured for orientation in a horizontal plane, said base including a plurality of receiving locations spaced apart along a first axis;

one or more pan members attached at selected receiving locations on said base configured to define a remainder length along said first axis unoccupied by pan members, said one or more pan members being raised relative to said base to form corresponding cavities in said pre-cast concrete wall section;

a pair of opposing sidewalls proximate said upper surface of said base and substantially parallel to said first axis, each of said sidewalls having a substantially vertical first position;

first and second opposing bulkheads proximate said upper surface and substantially perpendicular to said first axis, each of said bulkheads having a substantially vertical first position arranged to abut said pair of opposing sidewalls wherein said pair of sidewalls, said first and second bulkheads and said upper surface including said pan members define a form for the pre-cast concrete wall section; and said first bulkhead being configured for movement along said first axis through said remainder length so as to vary a first dimension of said form.

2. The tool of claim 1 wherein a number of said pan members is less than said plurality of receiving locations.

3. The tool of claim 1 wherein one of said sidewalls is rotatable away from said first position to a release position thereof.

4. The tool of claim 3 wherein the other one of said sidewalls is slidable so as to vary a second dimension of the form perpendicular to said first dimension.

5. The tool of claim 1 wherein said second bulkhead is rotatable away from said first position to a release position thereof.

6. The tool of claim 5 further including indicia visible thereon corresponding to said first dimension.

7. The tool of claim 1 wherein said base includes a flat skin portion defining a portion of said upper surface, said pan members comprising a fixed pan portion and a removable pan portion each raised relative to said flat skin portion.

8. The tool of claim 7 wherein said removable pan portion is configured to be removably mounted to said flat skin portion adjacent said fixed pan portion, said removable pan portion and said fixed pan portion being arranged along an axis substantially perpendicular to said first axis, said removable pan portion forming an extension of said fixed pan portion to thereby extend said corresponding cavity in the pre-cast concrete wall section.

9. The tool of claim 8 wherein said removable pan portion includes a cap and a diaphragm at opposing ends thereof, said removable pan being mounted so that said diaphragm is proximate said fixed pan portion, said removable pan portion further including a reveal member projecting therefrom and disposed in relief relative to said flat skin portion, said reveal member configured to form a corresponding incuse reveal feature in the pre-cast concrete wall section.

10. The tool of claim 9 wherein said base includes a plurality of said fixed pan portions, and a corresponding plurality of removable pan portions mounted to said flat skin portion.

11. The tool of claim 8 further including one of a support beam pan and a window pan configured to form a support beam blockout and a window blockout, respectively, in the pre-cast concrete wall section.

12. The tool of claim 1 having an arrangement wherein said second bulkhead is a first distance from a nearest pan member when in said first position, and said first bulkhead is a second distance greater than said first distance from a nearest pan member when in said first position.

13. The tool of claim 12 further including at least one plug disposed in said form proximate one of said first and second bulkheads configured to form a corresponding through-bore in the pre-cast concrete wall section.

14. The tool of claim 12 further including at least one plug disposed in said form proximate one of said first and second sidewalls configured to form a corresponding through-bore in the pre-cast concrete wall section.

15. The tool of claim 1 wherein said first dimension corresponds to a length of said pre-cast concrete wall section.

16. The tool of claim 15 wherein a second dimension of said form substantially perpendicular to said first dimension corresponds to a height of said pre-cast concrete wall section.

17. The tool of claim 1 wherein said tool includes means for producing a notch configured to receive a sealant.

18. A casting tool for forming a pre-cast concrete wall section comprising:

a base having an upper surface and configured for orientation in a horizontal plane, said base including a plurality of receiving locations spaced apart along a first axis;

one or more pan members attached at selected receiving locations on said base configured to define a remainder length along said first axis unoccupied by pan members, said one or more pan members being raised relative to said base to form corresponding cavities in said pre-cast concrete wall section;

a pair of opposing sidewalls proximate said upper surface of said base and substantially parallel to said first axis, each of said sidewalls having a substantially vertical first position;

first and second opposing bulkheads proximate said upper surface and substantially perpendicular to said first axis, each of said bulkheads having a substantially vertical first position arranged to abut said pair of opposing sidewalls wherein said pair of sidewalls, said first and second bulkheads and said upper surface including said pan members define a form for the pre-cast concrete wall section; and an arrangement configured to vary a height dimension of said form selected from the group comprising (i) an elongated insert having a length corresponding to said sidewall, having a predetermined width, and disposed proximate an inner surface of said sidewall to thereby reduce said height dimension; and (ii) one of said sidewalls being configured for movement along a second axis substantially perpendicular to said first axis.

19. The tool of claim 18 wherein said first bulkhead is configured for movement along said first axis through said remainder length so as to vary a length dimension of said form.

20. The tool of claim 18 further including indicia visible thereon corresponding to said first dimension.

21. The tool of claim 18 wherein said base includes a flat skin portion defining a portion of said upper surface, said pan members comprising a fixed pan portion and a removable pan portion each raised relative to said flat skin portion.

22. The tool of claim 21 wherein said removable pan portion is configured to be removably mounted to said flat skin portion adjacent said fixed pan portion, said removable pan portion and said fixed pan portion being arranged along an axis substantially perpendicular to said first axis, said removable pan portion forming an extension of said fixed pan portion to thereby extend said corresponding cavity in the pre-cast concrete wall section.

23. The tool of claim 22 wherein said removable pan portion includes a cap and a diaphragm at opposing ends thereof, said removable pan being mounted so that said diaphragm is proximate said fixed pan portion, said removable pan portion further including a reveal member projecting therefrom and disposed in relief relative to said flat skin portion, said reveal member configured to form a corresponding incuse reveal feature in the pre-cast concrete wall section.

24. The tool of claim 23 further including one of a support beam pan and a window pan configured to form a support beam blockout and a window blockout, respectively, in the pre-cast concrete wall section.

25. The tool of claim 19 having an arrangement wherein said second bulkhead is a first distance from a nearest pan member when in said first position, and said first bulkhead is a second distance greater than said first distance from a nearest pan member when in said first position.

26. The tool of claim 25 further including at least one plug disposed in said form proximate one of said first and second bulkheads configured to form a corresponding through-bore in the pre-cast concrete wall section.

27. The tool of claim 26 further including at least one plug disposed in said form proximate one of said first and second sidewalls configured to form a corresponding through-bore in the pre-cast concrete wall section.

* * * * *